US010443587B2

(12) United States Patent
Flo et al.

(10) Patent No.: US 10,443,587 B2
(45) Date of Patent: Oct. 15, 2019

(54) HIGH-PRESSURE FUEL PUMP

(71) Applicant: Robert Bosch GmbH, Stuttgart (DE)

(72) Inventors: Siamend Flo, Schwieberdingen (DE); Oliver Albrecht, Bietigheim-Bissingen (DE); Frank Nitsche, Remseck am Neckar (DE); Thorsten Allgeier, Untergruppenbach (DE); Juergen Koreck, Ludwigsburg (DE); Andreas Plisch, Marbach (DE); Gerd Teike, Ditzingen (DE)

(73) Assignee: Robert Bosch GmbH, Stuttgart (DE)

( * ) Notice: Subject to any disclaimer, the term of this patent is extended or adjusted under 35 U.S.C. 154(b) by 263 days.

(21) Appl. No.: 14/901,075

(22) PCT Filed: May 13, 2014

(86) PCT No.: PCT/EP2014/059725
§ 371 (c)(1),
(2) Date: Dec. 28, 2015

(87) PCT Pub. No.: WO2014/206628
PCT Pub. Date: Dec. 31, 2014

(65) Prior Publication Data

US 2016/0131120 A1 May 12, 2016

(30) Foreign Application Priority Data

Jun. 28, 2013 (DE) ..... 10 2013 212 565

(51) Int. Cl.
*F04B 11/00* (2006.01)
*F02M 55/04* (2006.01)
(Continued)

(52) U.S. Cl.
CPC ..... *F04B 11/0091* (2013.01); *F02M 55/04* (2013.01); *F02M 59/025* (2013.01);
(Continued)

(58) Field of Classification Search
CPC ..... F04B 11/0091; F04B 11/0016; F04B 11/0008; F04B 11/00; F04B 19/22;
(Continued)

(56) References Cited

U.S. PATENT DOCUMENTS 3,672,398 A * 6/1972 Ichiryu ..... F04B 11/0016 137/565.34
4,324,276 A 4/1982 Kemner
(Continued)

FOREIGN PATENT DOCUMENTS

CN 101189069 A 5/2008
CN 101311523 A 11/2008
(Continued)

OTHER PUBLICATIONS

International Search Report corresponding to PCT Application No. PCT/EP2014/059725, dated Oct. 17, 2014 (German and English language document) (7 pages).

*Primary Examiner* — Philip E Stimpert
(74) *Attorney, Agent, or Firm* — Maginot, Moore & Beck LLP

(57) ABSTRACT

A high-pressure fuel pump includes a pump housing with a housing wall and a damping device configured to damp inlet-side pressure pulses by varying a damping volume with an elastically deformable wall. At least one section of the elastically deformable wall is formed from one or more of at least one part of a jacket-like area of the housing wall and at least one part of a sealing support. The section is embodied such that it includes at least one main part configured to vary the damping volume.

10 Claims, 4 Drawing Sheets

(51) Int. Cl.

| | |
|---|---|
| ***F02M 59/10*** | (2006.01) |
| ***F02M 59/44*** | (2006.01) |
| ***F02M 59/02*** | (2006.01) |
| ***F04B 19/22*** | (2006.01) |
| ***F04B 53/10*** | (2006.01) |
| ***F04B 53/14*** | (2006.01) |
| ***F04B 53/16*** | (2006.01) |
| ***F02M 59/48*** | (2006.01) |

(52) U.S. Cl.
CPC ..... *F02M 59/102* (2013.01); *F02M 59/44* (2013.01); *F04B 19/22* (2013.01); *F04B 53/10* (2013.01); *F04B 53/14* (2013.01); *F04B 53/16* (2013.01); *F02M 59/48* (2013.01); *F02M 2200/315* (2013.01)

(58) Field of Classification Search
CPC ..... F04B 53/10; F04B 53/14; F04B 53/16; F02M 55/04; F02M 59/025; F02M 59/102; F02M 59/44; F02M 59/48; F02M 2200/315
See application file for complete search history.

(56) References Cited

U.S. PATENT DOCUMENTS 6,062,831 A * 5/2000 Konishi ..... F02M 55/04 417/540
6,142,060 A * 11/2000 Saito ..... F04B 1/141 417/269
6,675,657 B1 1/2004 KalTsounis et al.
2009/0044783 A1* 2/2009 Fischer ..... F02M 59/44 123/495
2010/0215529 A1* 8/2010 Inoue ..... F04B 37/12 417/540
2012/0325922 A1 12/2012 Sumida

FOREIGN PATENT DOCUMENTS

| | | | |
|---|---|---|---|
| CN | 103282615 | A | 9/2013 |
| CN | 105765189 | A | 7/2016 |
| DE | 10 2011 018 569 | A1 | 10/2012 |
| DE | 10 2012 205 114 | A1 | 10/2012 |
| EP | 1 995 446 | A2 | 11/2008 |
| EP | 2 317 120 | A1 | 5/2011 |
| JP | 2000-88175 | A | 3/2000 |
| JP | 2005-155404 | A | 6/2005 |
| JP | 2011-1865 | A | 1/2011 |
| JP | 2011-080389 | A | 4/2011 |
| JP | 2012-132400 | A | 7/2012 |
| WO | 2012/157066 | A1 | 11/2012 |
| WO | 2013/018129 | A1 | 2/2013 |
| WO | 2013/042472 | A1 | 3/2013 |

* cited by examiner

HIGH-PRESSURE FUEL PUMP

This application is a 35 U.S.C. § 371 National Stage Application of PCT/EP2014/059725, filed on May 13, 2014, which claims the benefit of priority to Serial No. DE 10 2013 212 565.8, filed on Jun. 28, 2013 in Germany, the disclosures of which are incorporated herein by reference in their entirety.

BACKGROUND

The disclosure relates to a high-pressure fuel pump.

Fuel systems of combustion engines in which fuel is pumped at high pressure out of a fuel tank into a fuel rail by means of a pre-supply pump and of a mechanically driven high-pressure fuel pump are known commercially. A pressure damping device is usually arranged on or in a housing of a high-pressure fuel pump of this kind. This pressure damping device is generally arranged in a cover section of the housing which is connected to a low-pressure region and in which a gas-filled pressure capsule is arranged. This damping device is used to damp pressure pulses in the low-pressure region of the fuel system

SUMMARY

The problem underlying the disclosure is solved by a high-pressure fuel pump. Advantageous developments are indicated in dependent claims. Features of importance for the disclosure can furthermore be found in the following description and in the drawings, wherein the features may be of importance for the disclosure either in isolation or in various combinations even if no further explicit reference is made to this fact.

In the case of the high-pressure fuel pump according to the disclosure, there is no need for a pressure capsule to damp pressure pulses. Instead, a component which is necessarily present in any case, namely a housing wall and/or a seal support, is used to provide deformations and thus for damping the pressure pulses. The housing wall and/or seal support can, as it were, "breathe". The high-pressure fuel pump according to the disclosure thus has fewer parts and can therefore be produced at low cost. The parts required are furthermore very simple in design, and this likewise reduces production costs and furthermore increases operational reliability and hence the service life and durability of the high-pressure fuel pump.

A first development according to the disclosure envisages that the damping volume has a volume of 60 $cm^3$ to 140 $cm^3$, in particular 80 $cm^3$ to 120 $cm^3$, in an unpressurized state of rest, that is to say when the pressure in the damping volume is approximately atmospheric pressure, and the housing wall has a wall thickness of 0.8 mm to 2 mm, preferably a wall thickness of 1 mm to 1.7 mm, in particular a wall thickness of 1.2 mm to 1.5 mm. An embodiment of the high-pressure fuel pump with a damping volume in the range of values indicated and/or a housing wall having wall thicknesses in the range of values indicated has the advantage that pressure pulses which occur in conventional common rail fuel systems can be damped in a sufficiently effective way. The values indicated refer to a high-pressure fuel pump for a conventional passenger vehicle. If the size of the high-pressure fuel pump is changed, the values indicated may have to be adapted accordingly.

Another development of the high-pressure fuel pump envisages that the jacket-like region of the housing wall has a corrugated section. Embodying one section of the jacket-like region as a corrugated section makes this section particularly mobile and enables it to damp pressure pulses in a particularly efficient way while simultaneously having a long service life. The jacket-like region thus becomes a kind of corrugated bellows, the design and inherent elasticity of which enable it to provide a large damping volume.

Another development of the high-pressure fuel pump according to the disclosure envisages that the housing wall and/or the seal support is/are produced at least partially using plastic and/or steel sheet. Plastic offers the advantage of a low-cost production method. Steel sheet is corrosion resistant, particularly elastic and robust. A combination of plastic and steel sheet allows a particularly advantageous embodiment, in which an inner layer of the pump housing can be produced from steel sheet, while an outer layer can be produced from plastic. This offers the advantage that the corrosion resistance and elasticity of the steel sheet can be combined with the noise attenuating properties of plastic.

Another development of the high-pressure fuel pump according to the disclosure is distinguished by the fact that the parts of the jacket-like region of the housing wall and/or of the seal support which are used for pressure pulse damping are rotationally symmetrical. Rotationally symmetrical outlines offer the advantage of advantageous production, e.g. by means of a deep drawing method. Rotationally symmetrical outlines are furthermore advantageous in respect of installation dimensions of the high-pressure fuel pump according to the disclosure.

It is likewise according to the disclosure that the pump housing has a connection device for connection to a low-pressure line of a fuel system. The arrangement of a connection device on the pump housing has the advantage that fuel which is drawn in from a low-pressure line flows through the damping volume in a suitable way. Efficient damping of the pressure pulses is thereby ensured. In the case of a cylindrical, pot-type housing, there is, of course, the option of providing the connection device on a bottom section, thus enabling the circumferential section to perform its function of pressure pulse damping without being impaired.

BRIEF DESCRIPTION OF THE DRAWINGS

Examples of the present disclosure are explained in greater detail below with reference to the attached drawing. In the drawings.

DETAILED DESCRIPTION

Figure 1:
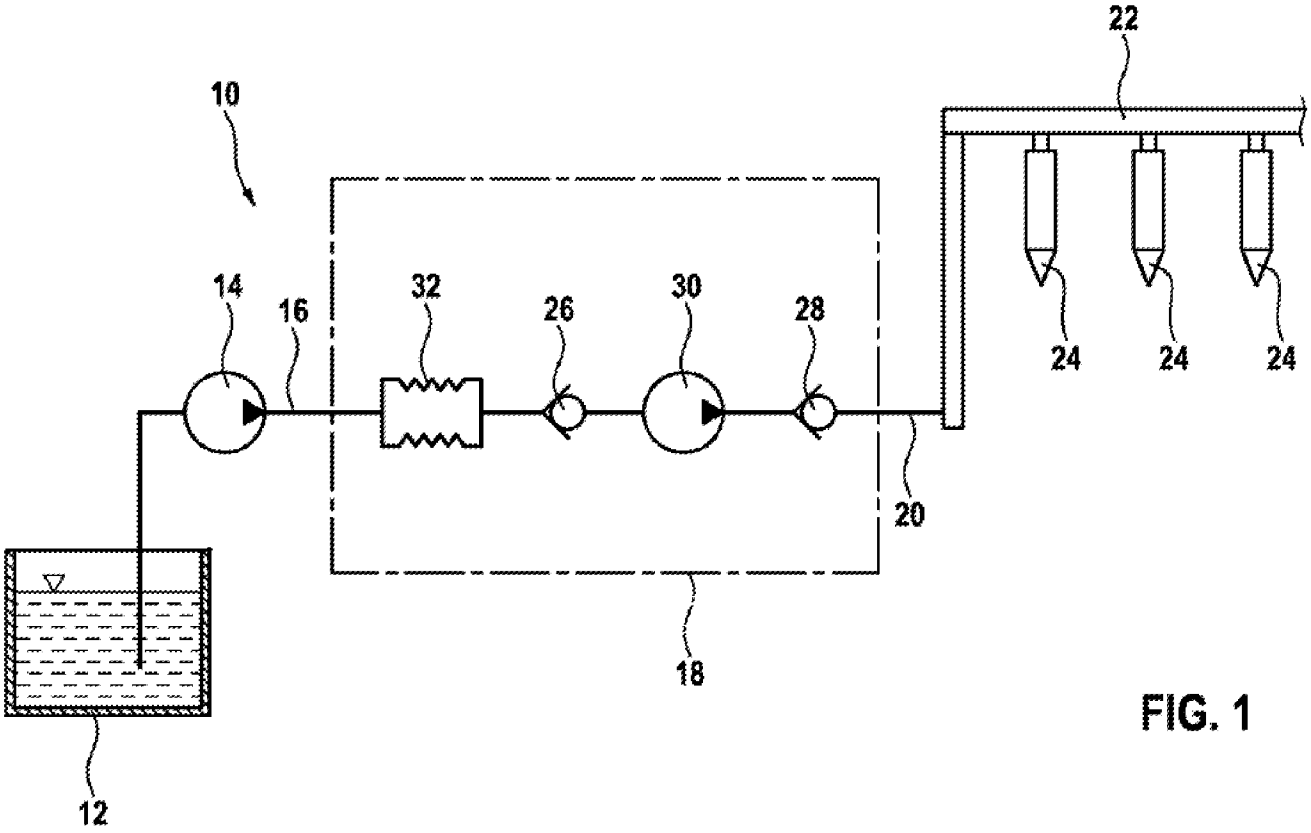
FIG. 1 shows a schematic illustration of a fuel system of a combustion engine having a high-pressure fuel pump.

In FIG. 1, a fuel system of a combustion engine bears the overall reference sign 10. It comprises a fuel tank 12 for holding fuel. An electric pre-supply pump 14 is connected to said fuel tank 12. Connected to the pre-supply pump 14 there is in turn a low-pressure line 16. This leads to a high-pressure fuel pump 18, indicated overall by a chain-dotted line, which is embodied in the form of a piston pump in this example. A high-pressure line 20 leads from said pump to a fuel rail 22. A plurality of injectors 24 is connected to the fuel rail 22. A fuel delivery flow in this fuel system is directed from the fuel tank 12 toward the injectors 24.

The high-pressure fuel pump 18 comprises an inlet valve embodied as a check valve and an outlet valve 28 embodied as a check valve, as well as a displacer space 30, which is indicated in FIG. 1 by the known pump symbol. Arranged ahead of the inlet valve 26 in the direction of the fuel delivery flow is a damping device 32, which, in this example, is embodied as part of the high-pressure fuel pump 18, as will be explained in greater detail below. The damping device 32, in turn, is connected fluidically to the low-pressure line 16, as will be explained in greater detail below.

Figure 2:
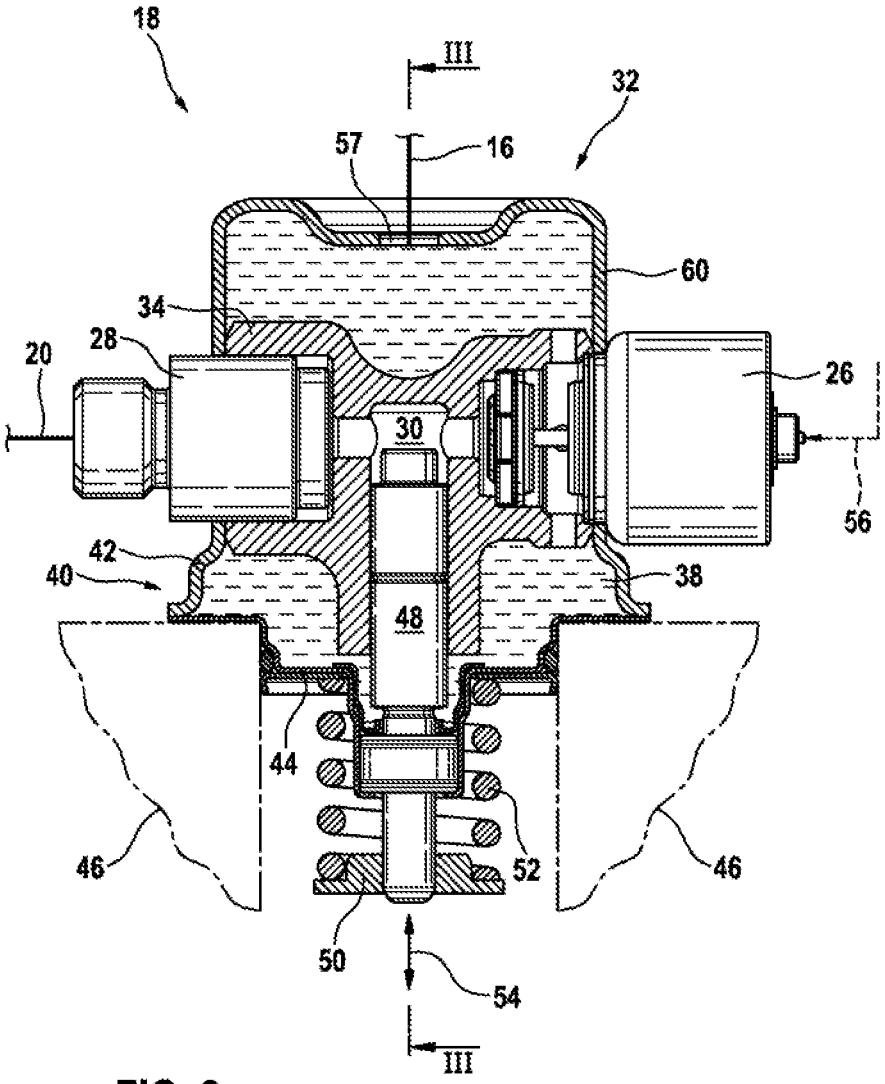
FIG. 2 shows a section through the high-pressure fuel pump in FIG. 1.

In FIG. 2, the high-pressure fuel pump 18 is shown in greater detail. The high-pressure fuel pump 18 comprises a pump body 34, which is of integral design in this example. The displacer space 30 is formed as a cavity in the pump body 34. A piston 48 is arranged movably in the displacer space 30. A support element 50 is mounted on one end of the piston 48. The piston is loaded against a seal support 44 by a spring 52 resting on the support element 50. The piston 48 is pushed out of the displacer space 30 by the loading by way of the spring 52. During the operation of the high-pressure fuel pump, the piston 48 is moved up and down in the displacer space 30 by a camshaft (not shown). This movement is indicated by a double arrow 54. Control signals pass to the inlet valve 26 via a control input 56 and specify the opening thereof.

Figure 3:
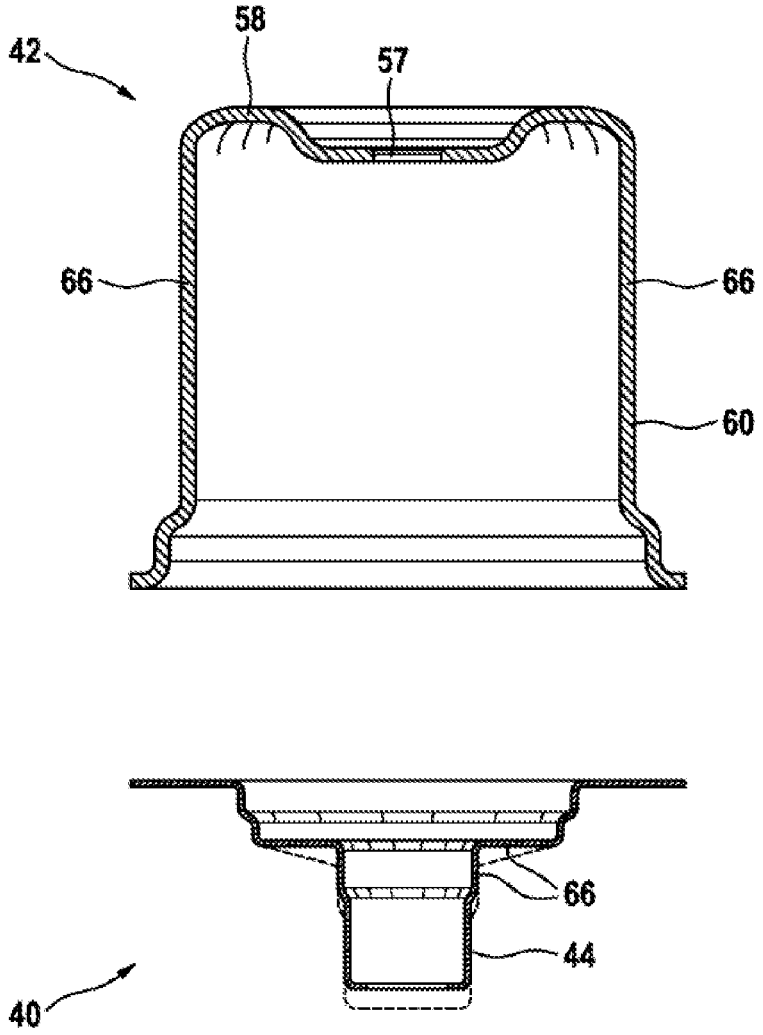
FIG. 3 shows a section through a pump housing of the high-pressure fuel pump from FIG. 2 along a line III-III.

The high-pressure fuel pump 18 furthermore has a pump housing 40, which comprises a housing pot 42 and the seal support 44 connected fluidtightly (e.g. by welding) thereto (see also FIG. 3). The housing pot 42 is inserted into an opening (without a reference sign) in an engine block 46 (indicated in FIG. 2 by a chain-dotted line).

The housing pot 42, in turn, comprises a jacket-like region 60, which is radially on the outside in FIGS. 2 and 3, and a cap region 58 of a housing wall (not provided with any further reference sign), said cap region being at the top in FIGS. 2 and 3. In the cap region, there is a central opening 57, which is connected to a connection device (not shown), e.g. in the form of a welded-on connection stub. The opening 57 is thereby connected to the low-pressure line 16. The seal support 44 serves to retain a piston seal (not designated specifically) and extends downward and radially inward from a rim of the jacket-like region 60 of the housing pot 42, said rim being at the bottom in FIG. 2.

The housing pot 42 and the seal support 44 form an outer boundary of a damping volume 38 of the damping device 32, said volume being connected via the opening 57, on the one hand, to the low-pressure line 16 and, on the other hand, to the inlet valve 26 and therefore being filled with fuel during operation. The function thereof is to damp pressure pulses during operation through a change in volume. The thickness of the material of the jacket-like region 60, the type of material thereof and the structural configuration are chosen so that sections of the jacket-like region 60 form a wall of the damping device 32 which can move, in the present case in a radial direction, more specifically in such a way that this movable wall makes a predominant contribution to the variation in the damping volume 38 during operation. By way of example, the damping volume 38 has a volume of 60 $cm^3$ to 140 $cm^3$, in particular 80 $cm^3$ to 120 $cm^3$, in an unpressurized state of rest. The jacket-like region 60 of the housing wall preferably has a wall thickness of 0.8 mm to 2 mm, preferably a wall thickness of 1 mm to 1.7 mm, in particular a wall thickness of 1.2 mm to 1.5 mm.

The high-pressure fuel pump 18 and the damping device operate as follows: by means of an up-and-down movement of the piston 48 in accordance with the double arrow 54 in FIG. 2 and a corresponding controlled opening of the inlet valve 26, the fuel is drawn into the displacer space 30 from the low-pressure line 16 via the damping volume and the inlet valve 26, compressed by the piston 48 and pumped into the high-pressure line 20 via the outlet valve 28. From there, the fuel flows to the injectors 24 and onward into the combustion chambers associated therewith.

During the pumping of the fuel by the high-pressure fuel pump 18, pressure pulses occur ahead of the inlet valve 26, i.e. an actual pressure in the low-pressure line 16 deviates periodically from a desired pressure in the low-pressure line 16. These pressure pulses are caused by the discontinuous mode of operation of the high-pressure fuel pump 18, which is embodied as a piston pump, and are damped by means of the damping device 32, i.e. an amount of a periodic deviation of the pressure in the low-pressure line 16 from the desired pressure or from a mean pressure is reduced. This damping is made possible by a radial movement of the movable wall of the jacket-like region 60, which moves radially outward in the case of a pressure increase and moves radially inward in the case of a pressure decrease by virtue of inherent elasticity and in this way makes a predominant contribution to a variation in the damping volume 38.

Of course, the jacket-like region 60 is only radially movable in such a way that it makes a predominant contribution to the variation in the damping volume 32 where it is not hindered in such a movement by a connection to the pump body 34, for example. Thus, this movement is present more in those regions which are outside the section plane in FIG. 2, especially in those regions which are in the section plane shown in FIG. 3 and situated at an angle of 90° to the section plane in FIG. 2. The part of the jacket-like region 60 which is shown there thus forms a movable wall in the sense of the definition of the damping device 32 and is denoted by the reference sign 66.

The seal support 44 can also be counted as part of the movable wall 66 since it is dimensioned in such a way that its section at the bottom in FIGS. 2 and 3, which has a smaller diameter than the upper section, moves downward in the case of a pressure increase, this being indicated by a dashed line in FIG. 3.

Figure 4:
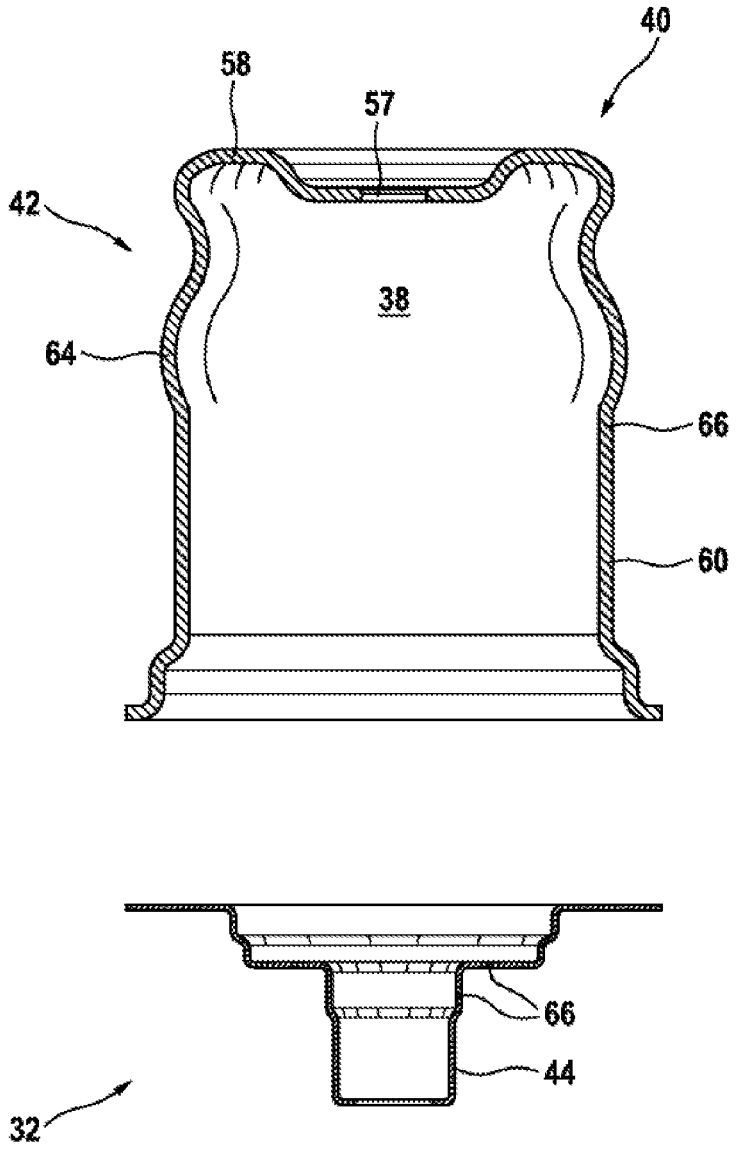
FIG. 4 shows an alternative embodiment of the pump housing.

An alternative embodiment of the pump housing 40 in FIG. 3 is shown in FIG. 4. The difference is that, in the illustrative embodiment in FIG. 4, the jacket-like region 60 has a section 64 embodied with encircling corrugations adjacent to the cap region 58. This makes it easier for the movable wall 66 of the housing pot 42 to "breathe", as in the case of a corrugated bellows or a folding bellows.

The invention claimed is:

1. A high-pressure fuel injection pump, comprising:

a pump housing having an exterior housing wall;

a damping device comprising an elastically movable wall defining a damping volume within the elastically movable wall, the damping device being configured to damp inlet-side pressure pulses by varying the damping volume with an elastic movement of the elastically movable wall;

a pump body defining a pump displacer space; and a piston configured to reciprocate within the pump displacer space, wherein at least one section of the elastically movable wall is formed by at least one part of an outer circumferential casing portion of the exterior housing wall, wherein a majority of the variation in the damping volume is provided by elastic movement of the at least one part of the outer circumferential casing portion, and wherein the damping volume surrounds at least one cross-section of the pump body.

2. The high-pressure fuel injection pump as claimed in claim 1, wherein the damping volume is greater than or equal to 60 $cm^3$ and less than or equal to 140 $cm^3$ in an unpressurized state of rest and the exterior housing wall has a wall thickness of greater than or equal to 0.8 mm and less than or equal to 2 mm.

3. The high-pressure fuel injection pump as claimed in claim 1, wherein the outer circumferential casing portion of the housing wall has a corrugated section that forms the at least one section of the elastically movable wall.

4. The high-pressure fuel injection pump as claimed in claim 1, wherein the exterior housing wall includes one or more of plastic and steel sheet.

5. The high-pressure fuel injection pump as claimed in claim 1, wherein the at least one section is rotationally symmetrical.

6. The high-pressure fuel injection pump as claimed in claim 1, wherein the pump housing has a connector configured to connect to a low-pressure line of a fuel system.

7. The high-pressure fuel injection pump as claimed in claim 1, wherein the damping volume is greater than or equal to 80 $cm^3$ and less than or equal to 120 $cm^3$ in an unpressurized state of rest and the exterior housing wall has a wall thickness of greater than or equal to 1 mm and less than or equal to 1.7 mm.

8. The high-pressure fuel injection pump as claimed in claim 7, wherein the wall thickness is greater than or equal to 1.2 mm and less than or equal to 1.5 mm.

9. The high-pressure fuel injection pump as claimed in claim 6, wherein the damping volume is fluidly connected to the low-pressure line via the connector.

10. A high-pressure fuel pump, comprising:

a pump housing having an exterior housing wall; and a damping device comprising an elastically movable wall defining a damping volume within the elastically movable wall, the damping device being configured to damp inlet-side pressure pulses by varying the damping volume with an elastic movement of the elastically movable wall, wherein at least one section of the elastically movable wall is formed by at least one part of a seal support configured to support a seal of the fuel pump, and wherein a majority of the variation in the damping volume is provided by elastic movement of the at least one part of the seal support.

* * * * *